US010259007B2

(12) United States Patent
Leschkies et al.

(10) Patent No.: US 10,259,007 B2
(45) Date of Patent: Apr. 16, 2019

(54) METHOD AND APPARATUS FOR ALIGNING NANOWIRES DEPOSITED BY AN ELECTROSPINNING PROCESS

(71) Applicant: Applied Materials, Inc., Santa Clara, CA (US)

(72) Inventors: Kurtis Leschkies, Santa Clara, CA (US); Steven Verhaverbeke, San Francisco, CA (US); Robert Visser, Menlo Park, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 469 days.

(21) Appl. No.: 14/716,489

(22) Filed: May 19, 2015

(65) Prior Publication Data

US 2015/0251214 A1 Sep. 10, 2015

Related U.S. Application Data

(62) Division of application No. 13/623,819, filed on Sep. 20, 2012, now abandoned.

(Continued)

(51) Int. Cl.
*B05B 5/04* (2006.01)
*B05B 1/00* (2006.01)

(Continued)

(52) U.S. Cl.
CPC ..... *B05D 1/007* (2013.01); *B05B 5/04* (2013.01); *D01D 5/0061* (2013.01);

(Continued)

(58) Field of Classification Search
CPC ..... D01D 5/061; D01D 5/0092
See application file for complete search history.

(56) References Cited

U.S. PATENT DOCUMENTS 5,277,751 A * 1/1994 Ogle ..... H01J 37/321
2002/0089094 A1* 7/2002 Kleinmeyer ..... B82Y 30/00 264/465

(Continued)

FOREIGN PATENT DOCUMENTS

CN 1584135 A 2/2005
CN 1966399 A 5/2007

(Continued)

OTHER PUBLICATIONS

International Search Report and Written Opinion for PCT/US2012/056208 dated Feb. 1, 2013.

(Continued)

*Primary Examiner* — Dah-Wei D. Yuan
*Assistant Examiner* — Stephen A Kitt
(74) *Attorney, Agent, or Firm* — Patterson + Sheridan LLP

(57) ABSTRACT

Embodiments of the invention generally include apparatus and methods for depositing nanowires in a predetermined pattern during an electrospinning process. An apparatus includes a nozzle for containing and ejecting a deposition material, and a voltage source coupled to the nozzle to eject the deposition material. One or more electric field shaping devices are positioned to shape the electric field adjacent to a substrate to control the trajectory of the ejected deposition material. The electric field shaping device converges an electric field at a point near the surface of the substrate to accurately deposit the deposition material on the substrate in a predetermined pattern. The methods include applying a voltage to a nozzle to eject an electrically-charged deposition material towards a substrate, and shaping one or more electric fields to control the trajectory of the electrically-charged deposition material. The deposition material is then deposited on the substrate in a predetermined pattern.

11 Claims, 4 Drawing Sheets

Related U.S. Application Data

(60) Provisional application No. 61/547,656, filed on Oct. 14, 2011.

(51) Int. Cl.

| | |
|---|---|
| ***D01D 5/00*** | (2006.01) |
| ***D01D 11/06*** | (2006.01) |
| ***D01F 1/09*** | (2006.01) |
| ***D01F 6/50*** | (2006.01) |
| ***B05D 1/00*** | (2006.01) |
| *B22F 9/08* | (2006.01) |

(52) U.S. Cl.

CPC ..... *D01D 5/0092* (2013.01); *D01D 11/06* (2013.01); *D01F 1/09* (2013.01); *D01F 6/50* (2013.01); *B22F 2009/0888* (2013.01); *B22F 2009/0892* (2013.01); *B22F 2202/06* (2013.01)

(56) References Cited

U.S. PATENT DOCUMENTS

| | | | | |
|---|---|---|---|---|
| 2007/0272901 | A1 | 11/2007 | Gouma | |
| 2009/0091065 | A1* | 4/2009 | Katti | D01D 5/0076 264/465 |
| 2009/0285718 | A1 | 11/2009 | Privitera et al. | |
| 2009/0295014 | A1 | 12/2009 | Matsubayashi et al. | |
| 2010/0222771 | A1* | 9/2010 | Mitchell | A61L 27/14 606/1 |

FOREIGN PATENT DOCUMENTS

| | | | |
|---|---|---|---|
| CN | 101092232 | A | 12/2007 |
| KR | 20110062216 | A | 6/2011 |
| WO | 2008/040527 | A2 | 4/2008 |
| WO | 2011006967 | A1 | 1/2011 |

OTHER PUBLICATIONS

Chinese Office Action dated Mar. 18, 2015 for Application No. 201280052127.7.

Yu, J.H. et al., "Effect of viscosity of silver nanoparticle suspension on conductive line patterned by electrohydrodynamic jet printing", Applied Physics A 89 (2007), pp. 157-159.

Deitzel, J.M. et al., "Controlled deposition of electrospun poly(ethylene oxide) fibers", Polymer (2001), pp. 8163-8170.

Chinese Office Action dated Oct. 29, 2015 for Application No. 201280052127.7.

* cited by examiner

METHOD AND APPARATUS FOR ALIGNING NANOWIRES DEPOSITED BY AN ELECTROSPINNING PROCESS

CROSS-REFERENCE TO RELATED APPLICATIONS

This application is a divisional application of co-pending U.S. patent application Ser. No. 13/623,819, filed Sep. 20, 2012, which claims benefit of U.S. Provisional Patent Application Ser. No. 61/547,656, filed Oct. 14, 2011, which are herein incorporated by reference.

BACKGROUND OF THE INVENTION

Field of the Invention

Embodiments of the invention generally relate to methods and apparatus for depositing nanowires via electrospinning.

Description of the Related Art

In solar, display, and touch screen technologies, transparent conductive oxide (TCO) films are used as electrodes to provide low-resistance electrical contact to a device's active layers while also allowing the passage of light to and from the active layers. However, TCO films possess a number of disadvantages that reduce the absolute efficiency of the device in which the TCO film is utilized. For example, deposition of TCO films requires a balancing of optical transparency and sheet resistance. Thicker films or higher doping levels in the TCO films results in higher conductivities but a reduction in the optical transmission of light. Additionally, the use of TCO films in a device may also require the utilization of additional non-active film layers which can further reduce the absorption of light. Furthermore, TCO films are relatively expensive.

As an alternative to TCO films in devices, the use of metallic nanowires has been proposed. One method of depositing the metallic nanowires is electrospinning. The metallic nanowires are generally deposited onto a substrate surface in a random pattern. Electrospinning includes applying a high voltage to a metallic capillary containing a deposition material including a polymer and a metal. The voltage applied to the capillary creates an electric field sufficient to overcome the surface tension of the deposition material, causing ejection of a thin jet of the deposition material onto a substrate. The deposition material is allowed to deposit on the substrate surface in a random orientation, which is generally dictated by the charged deposition material's affinity for the grounded substrate.

After the material is deposited on the substrate, the deposition material is then annealed to remove volatile polymer components. The remainder of the deposition material is reduced using a reducing agent, such as hydrogen gas, to leave a conductive metal (e.g., a nanowire) on the surface of the substrate. However, due to the random deposition of the nanowires on the substrate, the nanowire pattern does not have a uniform thickness or conductivity, thereby adversely affecting device performance.

Therefore, there is a need for methods and apparatus for aligning nanowires deposited by an electrospinning process.

SUMMARY OF THE INVENTION

Embodiments of the invention generally include apparatus and methods for depositing nanowires in a predetermined pattern during an electrospinning process by controlling the trajectory of a deposition material during the electrospinning process. An apparatus includes a nozzle for containing and ejecting a deposition material and a voltage source coupled to the nozzle. The voltage source applies a voltage to the nozzle to eject the deposition material from the nozzle towards the substrate. One or more electric field shaping devices, such as coils or a counter electrode, are positioned to shape the electric field adjacent to the substrate to control the trajectory of the ejected deposition material. The electric field shaping features shape the electric field so that the electric field converges at a point near the surface of the substrate to accurately deposit the deposition material on the substrate in a predetermined pattern. The methods include applying a voltage to a nozzle to eject an electrically-charged deposition material towards the surface of a substrate, and shaping one or more electric fields to control the trajectory of the electrically-charged deposition material. The deposition material is then deposited on the substrate in a predetermined pattern by controlling the trajectory.

In one embodiment, an apparatus for electrospinning a material on a substrate comprises a reservoir for containing a deposition material and a nozzle in fluid communication with the reservoir. A substrate support is adapted to support a substrate adjacent to the nozzle. The apparatus also includes a voltage source coupled to the nozzle to apply an electric potential to the nozzle to eject the deposition material from the nozzle. An electric field shaping device comprising a counter electrode is positioned to shape an electric field between the substrate and the nozzle. The electric field shaping device is adapted to influence the trajectory of the deposition material ejected from the nozzle.

In another embodiment, an apparatus for electrospinning a material on a substrate comprises a reservoir for containing a deposition material and a nozzle in fluid communication with the reservoir. The nozzle is adapted to deliver the deposition material to a surface of a substrate. The apparatus also includes a substrate support movable relative to the nozzle. The substrate support is adapted to support the substrate adjacent to the nozzle. A voltage source is coupled to the nozzle to apply an electric potential to the nozzle to eject the deposition material from the nozzle. One or more coils are positioned around a process region located between the nozzle and the substrate support. The one or more coils are adapted to influence the trajectory of the deposition material ejected from the nozzle.

In another embodiment, a method of electrospinning a material on a substrate comprises applying a voltage to a nozzle to eject an electrically-charged deposition material towards a surface of a substrate, and shaping an electric field adjacent to the substrate to control the trajectory of the electrically-charged deposition material towards the surface of the substrate. The electrically-charged deposition material is then deposited on the surface of the substrate in a predetermined pattern by controlling the trajectory.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of the invention generally include apparatus and methods for depositing nanowires in a predetermined pattern during an electrospinning process by controlling the trajectory of a deposition material during the electrospinning process. An apparatus includes a nozzle for containing and ejecting a deposition material and a voltage source coupled to the nozzle. The voltage source applies a voltage to the nozzle to eject the deposition material from the nozzle towards the substrate. One or more electric field shaping devices, such as coils or a counter electrode, are positioned to shape the electric field adjacent to the substrate to control the trajectory of the ejected deposition material. The electric field shaping features shape the electric field so that the electric field converges at a point near the surface of the substrate to accurately deposit the deposition material on the substrate in a predetermined pattern. The methods include applying a voltage to a nozzle to eject an electrically-charged deposition material towards the surface of a substrate, and shaping one or more electric fields to control the trajectory of the electrically-charged deposition material. The deposition material is then deposited on the substrate in a predetermined pattern by controlling the trajectory.

Figure 1A:
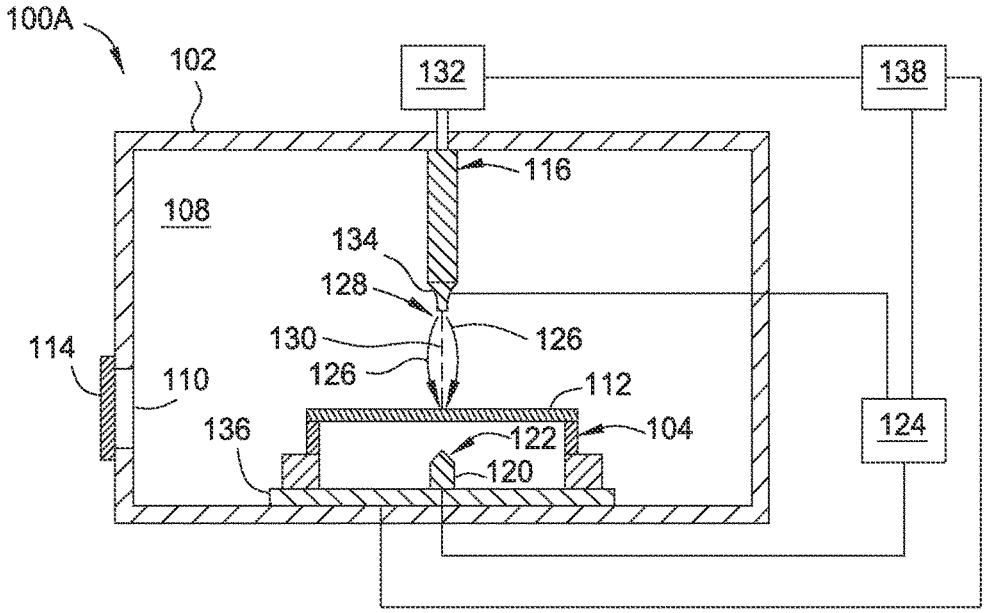
FIGS. 1A-1D are electrospinning apparatus according to embodiments of the invention.

FIGS. 1A-1D are electrospinning apparatus according to embodiments of the invention. FIG. 1A illustrates an electrospinning apparatus 100A. The electrospinning apparatus 100A includes an enclosure 102 having a substrate support 104 and a material delivery device 116 disposed therein. The enclosure 102 is formed from poly(methyl methacrylate) and is used to environmentally isolate an interior 108 of the electrospinning apparatus 100A. An opening 110 is formed through the enclosure 102 to facilitate ingress and egress of a substrate 112 to and from the interior 108 of the electrospinning apparatus 100A. An actuatable door 114 is adapted to seal the opening 110 during an electrospinning process and to facilitate environmental isolation of the enclosure 102.

The substrate support 104 is positioned within the enclosure 102 in a lower portion of the interior 108 of the electrospinning apparatus 100A. The substrate support 104 is adapted to support the substrate 112, such as a sheet of glass, polypropylene, or polyethylene terephthalate, adjacent to the material delivery device 116. The substrate support 104 is a frame having an opening formed through a central portion thereof to expose a back surface of the substrate 112 (e.g., the surface opposite the material delivery device 116) to a counter electrode 120. The opening through the substrate support 104 allows the counter electrode 120, such as an electrically conductive pin, post, or cylinder, to be positioned adjacent to the back surface of the substrate 112. The substrate support 104 is movable relative to the material delivery device 116 and the counter electrode 120 on a stage 136 positioned in the bottom of the enclosure 102. Movement of the stage 136 is facilitated by an actuator (not shown) and tracks formed within or on the bottom of the enclosure 102. Movement of the stage 136 along the bottom of the enclosure 102 facilitates the formation of a predetermined one- or two-dimensional pattern on an upper surface of the substrate 112 during processing. Thus, during an electrospinning process within the electrospinning apparatus 100A, the counter electrode 120 and the fluid delivery device 116 remain stationary, while the substrate 112 is moved relative to the counter electrode 120 and the fluid delivery device 116 to form a pattern of deposition material on the substrate surface. In one example, the predetermined pattern may be a one-dimensional pattern such as a line, or may be a two-dimensional pattern such as a weave or perpendicular lines.

The counter electrode 120 is an electric field shaping device. The counter electrode 120 is formed from an electrically conductive material, for example, a metal such as aluminum. The counter electrode 120 is coupled to a voltage source 124 which applies an electric potential to the counter electrode 120. The electrically charged counter electrode 120 shapes or influences electric field lines 126 located within a process region 128 between the material delivery device 116 and the substrate support 104. The counter electrode 120 causes the electric field lines 126 to converge at a single point near the surface of the substrate 122. The counter electrode 120 includes a tip 122 having a conical shape positioned at an end of the counter electrode 120 closest to the substrate 112. The tip 122 enables more precise control over the divergence point of the electric field lines 126. The tip 122 has a base width of about 10 millimeters and a height of about 5 millimeters.

The material delivery device 116, such as a syringe, is positioned adjacent to an upper surface of the substrate 112 and is adapted to deliver a deposition material 130 from a reservoir 132 through a nozzle 134 of the material delivery device 116 to the upper surface of the substrate 112. The nozzle 134 is also formed from an electrically conductive material, for example, a metal such as stainless steel, and is coupled to the voltage source 124. The nozzle 134 is adapted to be electrically biased by the voltage source 124, which overcomes the surface tension of the deposition material 130 present in the nozzle 134, thus ejecting the deposition material 130 towards the substrate 112.

A controller 138 is connected to the reservoir 132, the voltage source 124, and the stage 136 for controlling processes within the electrospinning apparatus 100A. The controller 138 controls the electric potential applied to the nozzle 134 and the counter electrode 120, as well as the movement of the stage 136, thus controlling the amount and position of deposited material on the upper surface of the substrate 112. The controller 138 facilitates formation of a predetermined pattern of deposition material 130 on the surface of the substrate 112 by controlling the x-y movement of the stage 136.

During an electrospinning deposition process in the electrospinning apparatus 100A, a deposition material 130 from the reservoir 132 is provided to the material delivery device 116. The deposition material 130 is suspended in the nozzle 134 of the material delivery device 116 by capillary action until an electric potential from the voltage source 124 is applied to the nozzle 134. The electric potential from the voltage source 124 overcomes the surface tension of the deposition material 130 in the nozzle 134, causing the deposition material 130 to be ejected from the nozzle 134. The application of the electrical potential from the voltage source 124 electrically charges the deposition material 130 ejected from the nozzle 134. The nozzle 134, and correspondingly the deposition material 130, is generally biased with a first polarity while the counter electrode 120 is biased with the opposite polarity. Biasing of the counter electrode 120 with the opposite polarity results in the convergence of an electric field near the surface of the substrate 112, thus directing the charged deposition material 130 to a desired area of the substrate. The deposition material 130 is attracted to the substrate at a point immediately above the tip 122 of the counter electrode due to the convergence of the electric field lines 126 caused by the counter electrode 120, thereby facilitating accurate deposition of the deposition material 130 on the substrate 112. Since the deposition material 130 is directed to a point immediately above the counter electrode 120, the substrate support 104 can be moved relative to the counter electrode 120 to deposit the deposition material 130 in a predetermined one- or two-dimensional pattern. For example, while deposition material 130 is being ejected from the nozzle 134, the substrate support 104 can be moved in the x-y directions to deposit a weave, perpendicular lines, or other predetermined patterned on the surface of the substrate 112.

While FIG. 1A illustrates one embodiment of an electrospinning apparatus 100A, other embodiments are also contemplated. In another embodiment, it is contemplated that the substrate support 104 may remain stationary within the enclosure 102 while either or both of the counter electrode 120 and the material delivery device 116 are movable. In yet another embodiment, it is contemplated that the substrate 112 may be a roll-to-roll or flexible substrate, and that the substrate support 104 may be adapted to support a flexible substrate using rollers. In yet another embodiment, it is contemplated that the dimensions of the tip 122 of the counter electrode 120 may be adjusted to effect the desired accuracy of alignment of the deposition material 130. Additionally, although the counter electrode 120 is described as shaping the electric field lines 126, it is to be understood that in some embodiments, the counter electrode may facilitate formation of the electric field lines 126, and not just shaping of the electric field lines 126.

Figure 1B:
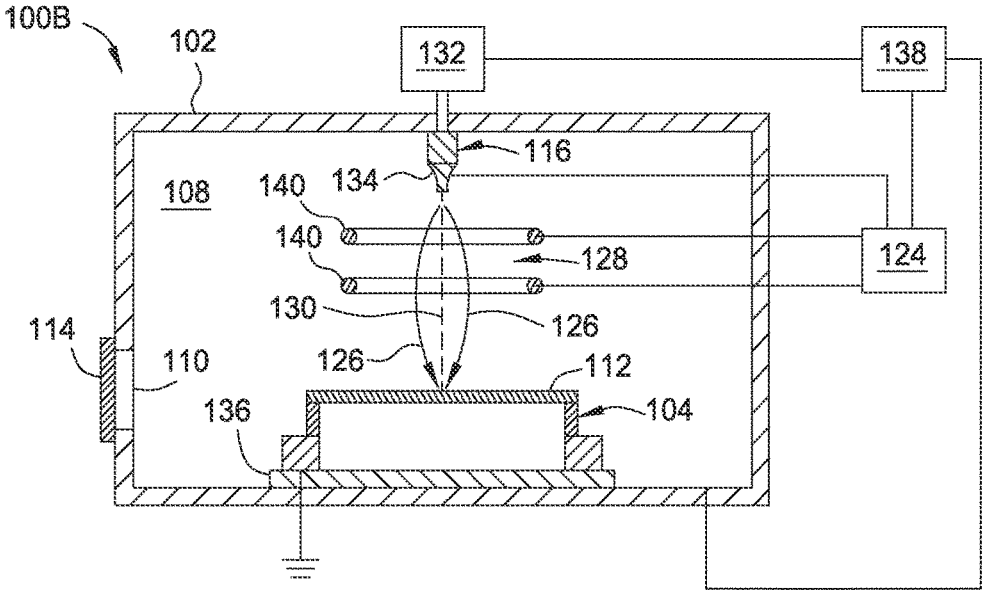

FIG. 1B illustrates an electrospinning apparatus 100B according to another embodiment of the invention. The electrospinning apparatus 100B is similar to the electrospinning apparatus 100A, except that the electrospinning apparatus 100B utilizes electrically charged coils 140 as an electric field shaping device rather than a counter electrode. The electric coils 140 surround the process region 128 located between the substrate 112 and the nozzle 134, and facilitate shaping and influencing of electric field lines 126 present within the process region 128. The coils 140 are formed from an electrically conductive material, for example, a metal such as aluminum, and may be electrically biased by the voltage source 124 to shape the electric field lines 126 present within the process region. Unlike the counter electrode 120 of the electrospinning apparatus 100A (FIG. 1A), which is biased oppositely of the nozzle 134, the coils 140 are biased with the same polarity as the nozzle 134. Thus, the coils 140 facilitate accurate deposition of the deposition material 130 by centrally focusing the electric field lines 126 within the coils 140 and causing divergence of the electric field lines 126 near the upper surface of the substrate 112. The electric field lines 126 are centrally focused within the coils 140 due to the repulsive forces of the similarly-polarized nozzle 134, deposition material 130, and coils 140. During processing, the coils 140 are generally in a fixed position within the enclosure 102, while the substrate support 104 moves the substrate 112 relative to the coils and the nozzle 134 for depositing the deposition material 130 in a predetermined pattern. Since a counter electrode is not utilized in the electrospinning apparatus 100B, the substrate support 104 is grounded to assist in directing the electric field lines 126 from the nozzle 134 (which is generally positively biased) towards the substrate 112.

It is contemplated that less than two or more than two coils 140 may be positioned in the process region 128. It is further contemplated that the sizing and the spacing of the rings, both relative to one another as well as to the nozzle 134 and the substrate 112, may be adjusted to effect the desired trajectory of the deposition material 130. Additionally, it is contemplated that a single helical coil 140 may be positioned within the process region 128.

Figure 1C:
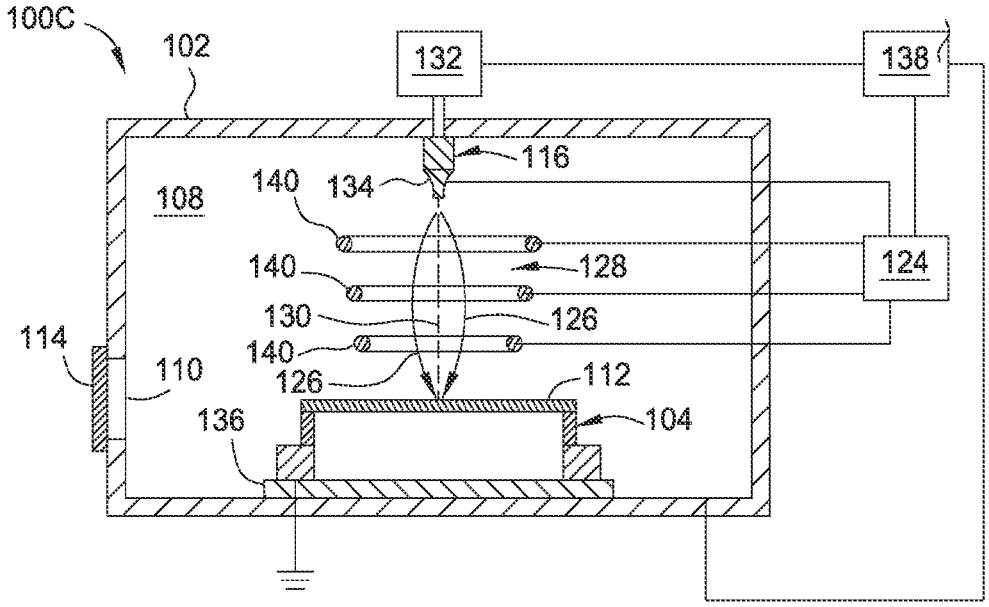

FIG. 1C illustrates an electrospinning apparatus 100C according to another embodiment of the invention. The electrospinning apparatus 100C is similar to electrospinning apparatus 100B, except that the diameter of each of the coils 140 decreases in a direction from the nozzle 134 to the substrate support 104 (e.g., downward toward the substrate support 104). Thus, the coils 140 form a cone-like shape which focuses the electric field lines 126 centrally within the coils 140 to direct the charged deposition material 130 to the desired location on a surface of the substrate 112. The decreasing diameter of the coils 140 may further increase the accuracy of the deposition of the deposition material 130 as compared to the coils 140 having the same diameter (as shown in FIG. 1B) by further facilitating convergence of the electric field lines 126.

Figure 1D:
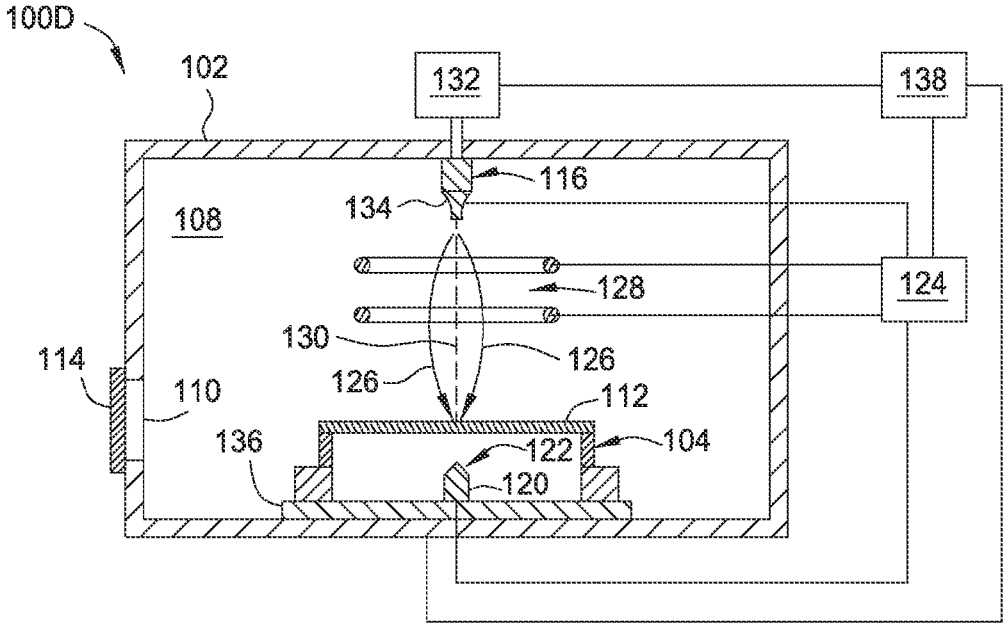

FIG. 1D illustrates an electrospinning apparatus 100D according to another embodiment of the invention. The electrospinning apparatus 100D is similar to the electrospinning apparatus 100A, except that the electrospinning apparatus 100D includes the coils 140 shown in FIG. 1B. Thus, the electrospinning apparatus 100B has two electric field shaping devices: the coils 140 and the counter electrode 120. The coils 140 and the counter electrode 120 are utilized to shape and converge the electric field lines 126 to deposit the deposition material 130 on the surface of the substrate 112 in a predetermined pattern. The combination of the counter electrode 120 and the coils 140 facilitates enhanced alignment of the deposition material 130 by shaping the electric field in two separate ways. The coils 140, which are electrically charged with the same polarity as the nozzle 134 and the deposition material 130, focus the electric field lines 126 centrally within the coils 140 by opposing the electric field lines 126 and pushing the electric field lines 126 inward. The counter electrode 120, which is electrically charged with the opposite polarity as compared to the deposition material 130, attracts the electric field lines 126 and the deposition material 130 to a precise location on the surface of the substrate 112. Thus, convergence of the electric field lines 126 is effected by two distinct electric field shaping devices. The synergistic effect of the coils 140 and the counter electrode 120 allows for a more precise degree of deposition accuracy of the deposition material 130 as compared to when either the coils 140 or the counter electrode 120 are used individually.

It is noted that the electrospinning apparatus 100A-100D are not to be limited by the orientations illustrated. It is contemplated that any of the electrospinning apparatus 100A-100D can be positioned horizontally, or inverted, or in any other operable orientation.

Figure 2:
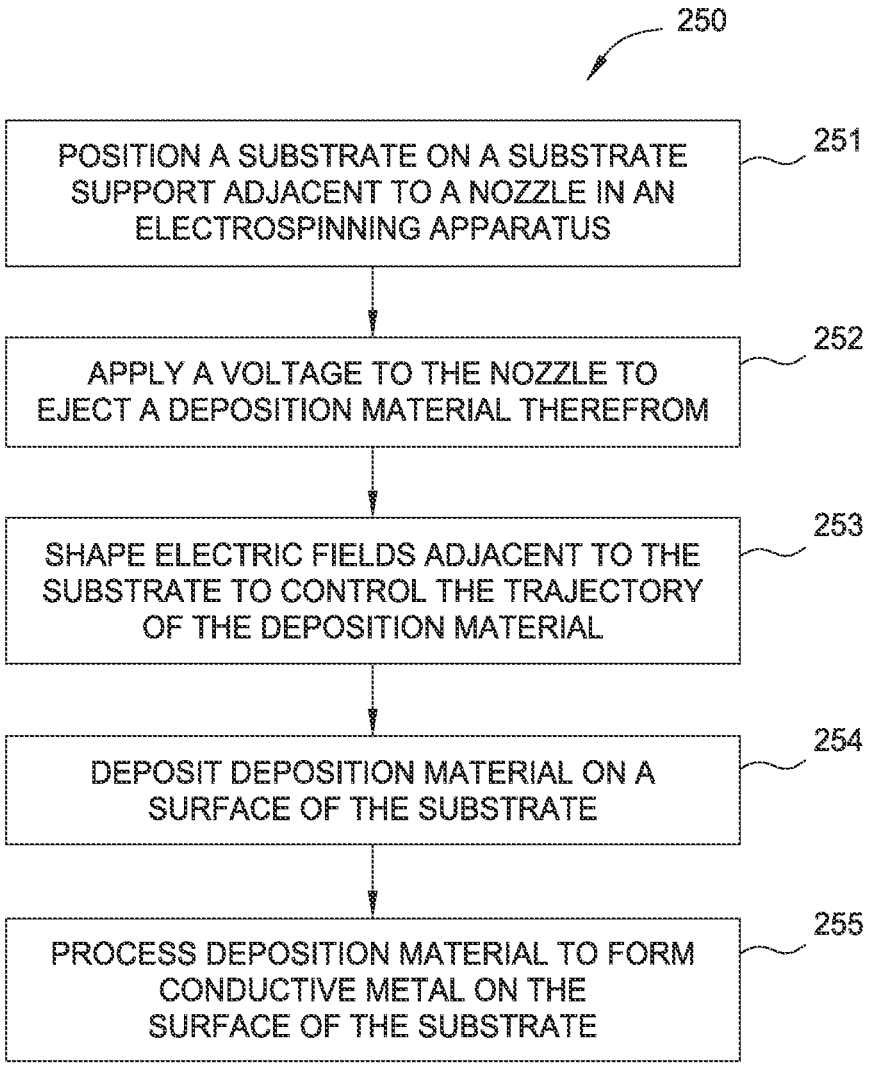
FIG. 2 is a flow diagram illustrating a method of depositing nanowires using an electrospinning apparatus according to one embodiment of the invention.

FIG. 2 is a flow diagram 250 illustrating a method of depositing nanowires according to one embodiment of the invention. The flow diagram 250 begins at operation 251, in which a substrate is positioned on a substrate support within an electrospinning apparatus. The substrate is positioned within the electrospinning apparatus adjacent to a nozzle of a material delivery device. In operation 252, a voltage from a voltage source is applied to the nozzle. The voltage, which may be in a range of about 5 kilovolts to about 40 kilovolts, overcomes the surface tension of a deposition material suspended in the nozzle, and ejects the deposition material from the nozzle. The deposition material generally includes a predetermined mixture of a polymer and a metal or metal-containing material. For example, the polymer may be polyvinyl acetate or polyvinyl alcohol in a concentration between about 1 percent weight and about 30 percent weight, such as about 3 percent weight to about 15 percent weight. The metal may be one or more of silver, copper, titanium, nickel, palladium, platinum, magnesium, gold, zinc, tungsten, or aluminum. The deposition material ejected from the nozzle generally has a viscosity of about 10 cP to about 50 cP.

Concurrent with the application of a voltage to the nozzle of the material delivery device, electric field lines adjacent to a substrate surface are shaped, influenced, or formed in order to control the trajectory of the deposition material and to direct the deposition material onto the substrate in a predetermined pattern. The electric fields are shaped using one or more electric field shaping devices, such as coils or a counter electrode, which are electrically biased by the voltage source. In operation 254, the one or more electric field shaping devices converge the electric field lines and direct the charged deposition material onto the substrate surface via electrostatics in order to form a predetermined one-, two-, or three-dimensional pattern on the substrate. The predetermined pattern may correspond to a desired structure, such as a pad, wire, or busbar, for a semiconductor device.

In operation 255, after the material has been deposited in a predetermined pattern on the substrate, the deposition material may be processed to remove the polymer material from the deposition material to leave a resulting nanowire. Removal of the polymer material leaves a metal or metal-containing material on the surface of the substrate having a thickness within a range of about 10 nanometers to about 10,000 nanometers. In an embodiment where a metal-containing material remains on the substrate, the metal-containing material may be reduced with a reducing gas, such as hydrogen or hydrogen radicals, to leave a conductive metal on the surface of the substrate. One example of a process to remove the polymer material includes annealing the substrate, and the deposition material thereon, in an annealing device at a temperature of about 25 degrees Celsius to about 250 degrees Celsius for about 5 minutes to about 10 minutes at a pressure of about 1 mTorr to about 760 Torr. Annealing of the deposition material evaporates the polymer from the surface of the substrate, leaving an electrically conductive metal in a predetermined pattern on a surface of the substrate.

While the flow diagram 250 illustrates one embodiment of a method of depositing nanowires by electrospinning, other embodiments are also contemplated. In another embodiment, it is contemplated that operation 255 may be excluded depending upon the composition of the deposition material.

Figure 3A:
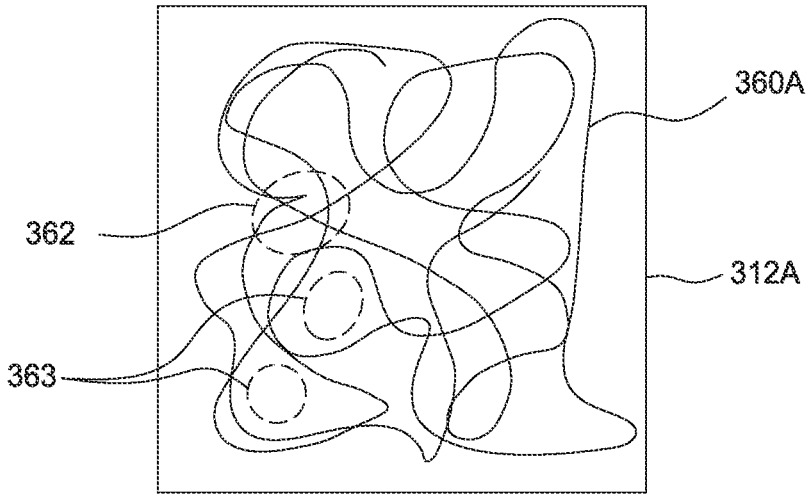
FIG. 3A (PRIOR ART)
FIGS. 3A-3B illustrate nanowires formed by electrospinning processes.
Figure 3B:
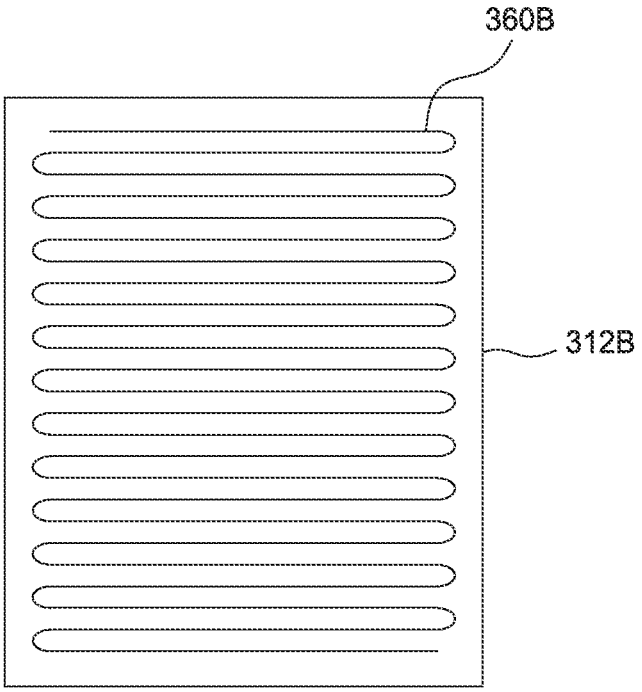

FIGS. 3A-3B illustrate nanowires formed by electrospinning processes. FIG. 3A illustrates a top perspective view of a substrate 312A having nanowires 360A thereon. The nanowires 360A are formed from a conductive material, such as a metal. The nanowires 360A were deposited by an electrospinning apparatus lacking an electric field shaping device. Thus, the nanowires 360A are randomly deposited on the substrate 312A. The substrate 312A includes areas with a high density of nanowires 360A, such as area 362, and areas with a low density of nanowires 360A, such as areas 363. The uneven distribution of nanowires 360A on the substrate 312A negatively impacts device performance.

FIG. 3B illustrates a top perspective view a substrate 312B having nanowires 360B thereon. The nanowires 360B are formed from a conductive material deposited according to an embodiment of the invention. Due to the use of an electric field shaping device during deposition, such as coils or a counter electrode, the nanowires 360B are deposited in a predetermined pattern rather than a random orientation. Thus, the nanowires 360B are deposited to a uniform thickness and density across the surface of the substrate 312B, thereby facilitating uniform conductivity across the surface of the substrate 312B. The uniform electrical conductivity across the surface of the substrate 312B maximizes device performance and efficiency. It is contemplated that the nanowires 360B can be deposited in predetermined patterns other than that illustrated in FIG. 3B.

Benefits of the present invention include methods and apparatus for aligning nanowires deposited during an electrospinning process. The methods and apparatus utilize one or more electric field shaping devices to converge an electric field within the apparatus to a desired point. The electric field shaping devices facilitate formation and alignment of a predetermined pattern of nanowires on the surface of a substrate. Thus, a metallic layer of uniform thickness and conductivity can be formed on the surface of a substrate. Metallic layers of uniform thickness and conductivity facilitate the formation of more efficient devices.

While the foregoing is directed to embodiments of the present invention, other and further embodiments of the invention may be devised without departing from the basic scope thereof, and the scope thereof is determined by the claims that follow.

We claim:

1. An apparatus for electrospinning a material on a substrate, comprising:

a reservoir for containing a deposition material;

a nozzle in fluid communication with the reservoir, the nozzle adapted to deliver the deposition material to a surface of a substrate;

a stage;

a substrate support coupled to the stage and movable via the stage relative the nozzle, wherein the substrate support comprises a height and a frame having a central opening therethough;

a voltage source coupled to the nozzle to apply an electric potential to the nozzle to eject the deposition material from the nozzle;

two or more coils positioned around a process region located between the nozzle and the substrate support, the two or more coils have decreasing diameters in a direction from the nozzle towards to the substrate support and adapted to influence the trajectory of the deposition material ejected from the nozzle; and a counter electrode extending from the stage into the central opening, wherein a height of the counter electrode is less than the height of the substrate support.

2. The apparatus of claim 1, wherein the counter electrode is positioned opposite of the nozzle, and wherein the counter electrode is coupled to the voltage source and is adapted to influence the trajectory of the deposition material ejected from the nozzle.

3. The apparatus of claim 2, wherein the voltage source is adapted to apply an electric potential to the two or more coils, and the electric potential applied to the two or more coils is of the same polarity as the electric potential applied to the nozzle.

4. The apparatus of claim 3, wherein the voltage source is adapted to apply an electric potential to the counter electrode, and the electric potential applied to the counter electrode is of the opposite polarity as the electric potential applied to the nozzle.

5. The apparatus of claim 4, wherein the counter electrode is a pin having a conical tip directed towards the central opening of the substrate support.

6. The apparatus of claim 1, wherein the two or more coils comprises a plurality of coils vertically spaced apart from one another and having axially aligned centers.

7. The apparatus of claim 1, wherein the two or more coils comprise an electrically conductive material.

8. The apparatus of claim 1, wherein the two or more coils comprises aluminum.

9. An apparatus for electrospinning a material on a substrate, comprising:

a reservoir for containing a deposition material;

a housing;

a nozzle disposed in the housing and in fluid communication with the reservoir, the nozzle adapted to deliver the deposition material to a surface of a substrate;

a stage;

a substrate support disposed in the housing, coupled to the stage, and movable via the stage relative the nozzle, wherein the substrate support comprises a height and a frame having a central opening therethough;

a counter electrode extending from the stage into the central opening of the substrate support and positioned opposite of the nozzle, a height of the counter electrode being less than the height of the substrate support, wherein the counter electrode is coupled to the voltage source and is adapted to influence the trajectory of the deposition material ejected from the nozzle;

a voltage source coupled to the nozzle to apply an electric potential to the nozzle to eject the deposition material from the nozzle; and one or more coils disposed in the housing and positioned around a process region located between the nozzle and the substrate support, the one or more coils adapted to influence the trajectory of the deposition material ejected from the nozzle.

10. The apparatus of claim 9, wherein the housing comprises poly(methyl methacrylate).

11. The apparatus of claim 9, wherein the voltage source is adapted to apply an electric potential to the one or more coils, and the electric potential applied to the one or more coils is of the same polarity as the electric potential applied to the nozzle, and wherein the voltage source is adapted to apply an electric potential to the counter electrode, and the electric potential applied to the counter electrode is of the opposite polarity as the electric potential applied to the nozzle.

* * * * *